United States Patent [19]

Troiano

[11] 3,970,142

[45] July 20, 1976

[54] FUEL SAVING DEVICE

[76] Inventor: Joseph Troiano, c/o Able Carting Corp., 80 Mahan St., West Babylon, N.Y. 11704

[22] Filed: Apr. 18, 1975

[21] Appl. No.: 569,457

[52] U.S. Cl. ..... 165/163; 122/32; 126/343.5 A

[51] Int. Cl.[2] ..... F28D 7/00

[58] Field of Search ..... 165/163, 74, 75; 122/243, 44 UR, 32; 126/110, 116, 350, 79

[56] References Cited

UNITED STATES PATENTS

| | | | |
|---|---|---|---|
| 1,805,321 | 5/1931 | Ullman | 122/32 |
| 1,985,637 | 12/1934 | Joyner | 122/32 |
| 2,110,742 | 3/1938 | Sengstaken | 122/32 X |
| 2,660,410 | 11/1953 | Hofmeister | 122/32 X |

*Primary Examiner*—Charles J. Myhre
*Assistant Examiner*—Theophil W. Streule, Jr.
*Attorney, Agent, or Firm*—Richard L. Miller

[57] ABSTRACT

A novel type of heat exchanger that pre-heats a fuel prior to being burned within a home furnace, so that the fuel burns better; the device consisting of a coiled tube running axially through a narrow pipe that extends transversely through a wide pipe, one of the pipes being located along a hot water line of the house that is used for washing, bathing and the like while the other pipe is along a house heating line such as for a baseboard hot water heating system, whereby use of either hot water line will preheat fuel moving through the coiled tube so that in effect the device forms a double heat exchanger.

4 Claims, 5 Drawing Figures

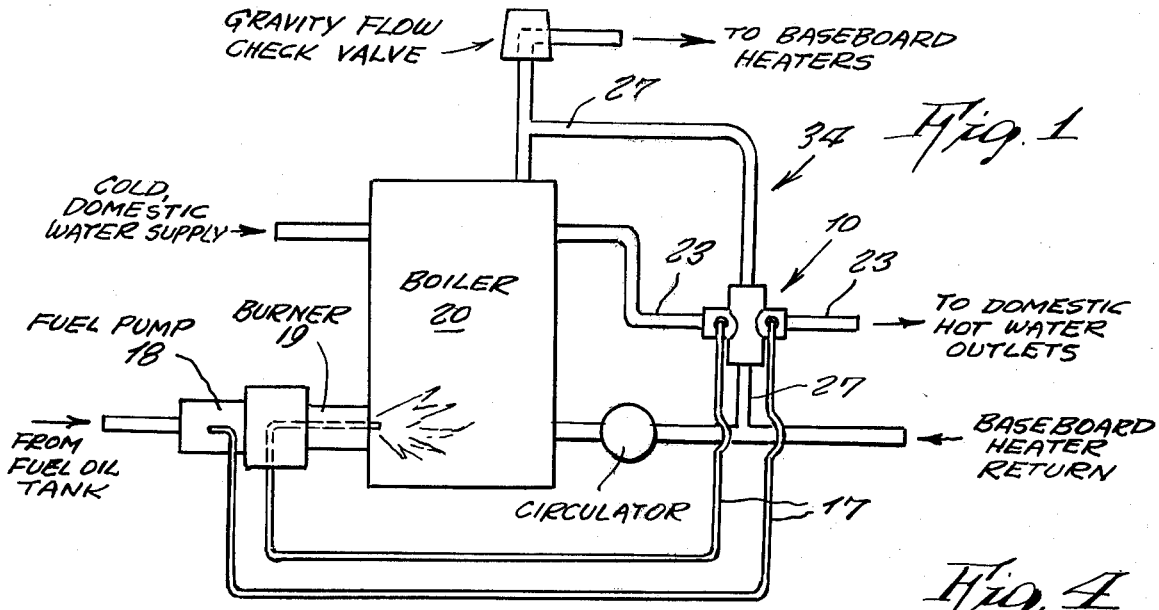
Fig. 1
Fig. 4
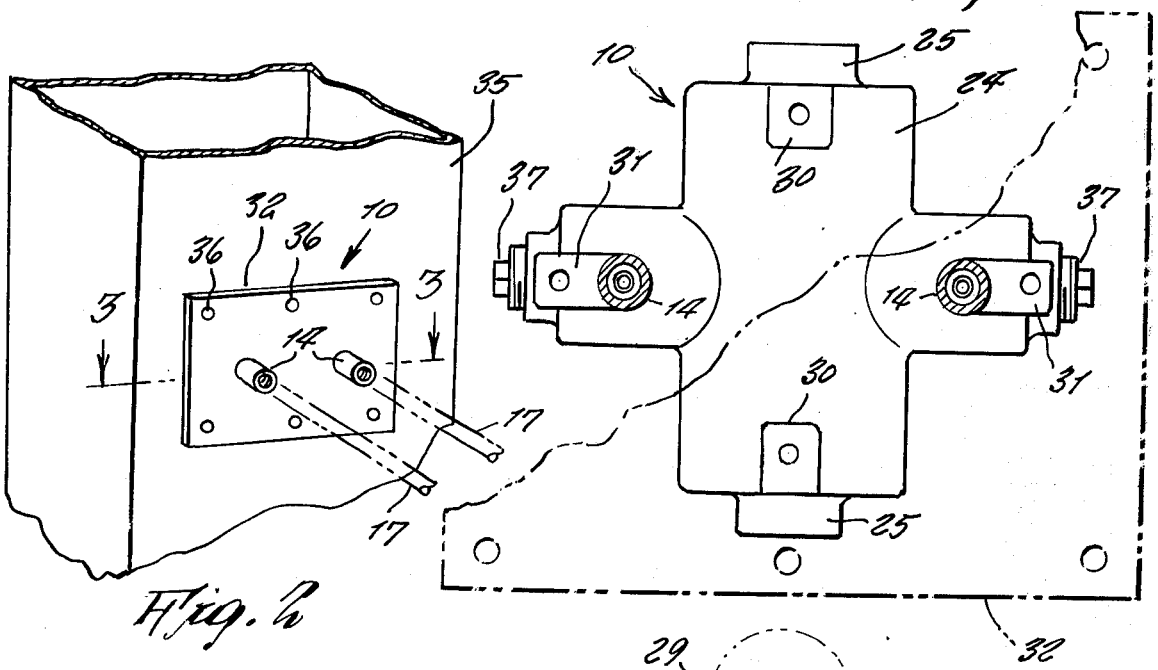
Fig. 2
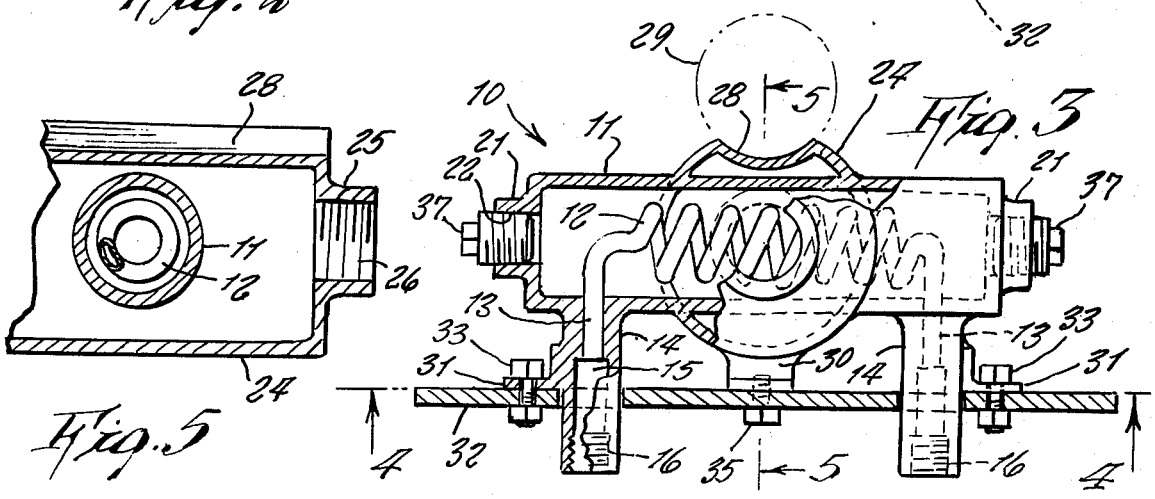
Fig. 3
Fig. 5

FUEL SAVING DEVICE

This invention relates generally to heat exchanger devices.

A principal object of the present invention is to provide a heat exchanger for installation along a furnace oil burner fuel line so to preheat the fuel before burning, and wherein the heat exchanger utilizes heat from both of a domestic hot water line used for washing and a baseboard house heating line.

Accordingly, another object is to provide a heat exchanger that thus constitutes a double heat exchanger.

Another object is to provide a heat exchanger which by preheating the furnace fuel oil, causes the oil viscosity to be more liquified so to burn more thoroughly and thus more cleanly without residue in order to reduce air pollution, and which also thus by more thorough burning extracts more heat energy out of the fuel so to conserve on the fuel.

Another object is to provide a fuel saving device which additionally is designed so to be able to partly wrap around an adjacent hot pipe and thus also extracts heat therefrom.

Still a further object is to provide a fuel saving device that can be mounted in a hot air duct so to extract heat therefrom.

Other objects are to provide a fuel saving device which is simple in design, inexpensive to manufacture, rugged in construction, easy to use and efficient in operation.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

FIG. 1 is a diagram of the invention in an operating system.

FIG. 2 is a perspective view of the invention mounted in a hot air duct.

FIG. 3 is a cross section on line 3–3 of FIG. 2.

FIG. 4 is a cross section on line 4—4 of FIG. 3.

FIG. 5 is a cross section on line 5—5 of FIG. 3.

Referring now to the drawing in detail, the reference numeral 10 represents a fuel saving device according to the present invention wherein there is a length of narrow pipe 11 that contains a coil 12 made of tubing and which extends along the central axis of the narrow pipe. The opposite ends 13 of the tubing terminates within extensions 14 that protrude on an outer side of the pipe. An opening 15 through each extension receives at one end the tubing end 13 and is threaded at its other end 16 in order to be connected to a fuel line 17 that carries fuel oil from a fuel pump 18 to a burner 19 of a boiler or furnace 20.

The opposite ends of the narrow pipe may terminate in necks 21 each of which has a threaded opening 22 for connection along a domestic hot water line 23 that supplies hot water from the furnace to a clothes washing machine, dishwasher bathtubs, showers, and kitchen and bathroom sinks.

The narrow pipe 11 extends transversely through a wide pipe 24 which at its opposite ends terminates in necks 25 each of which has a threaded opening 26 for connection along a hot water line 27 that runs between the house room baseboard heaters and the furnace. A concavity 28 along the outer side of pipe 24 allow a maximum surface contact against a hot water pipe 29 when the device 10 is placed thereagainst so to obtain heat therefrom.

The pipe 24 may have a pair of pads on feet 30 molded on one side, and the extensions 14 of pipe 11 may have sidewards lugs 31 molded along a side; the feet 30 and lugs 31 serving to rest against a side of a flat panel 32 on which the pipes are mounted and secured thereto by screws or bolts 33.

It is to be understood that the narrow and wide pipes are preferably molded as a single part so to be efficiently produced.

As shown in FIG. 1, the fuel saving device 10 may be mounted in a furnace heating system 34 without need of the mounting plate or panel 32. However, when the device is to be installed on an air duct 35, as shown in FIG. 2, for utilizing the heat of hot air moving therethrough, a large hole is cut into the duct so that the narrow and wide pipes are received within the duct, the panel 32 covering the duct large hole, and being secured to the duct by mounting screws 36. In this use of the invention, if the narrow and wide pipes are not connected to any hot water lines, their opposite end openings 22 and 26 may be plugged up by means of plugs 37, and only the extensions 14 outwardly protrude through the panel so to connect to the fuel oil line 17.

Thus a practical fuel saving device is provided.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. In a heating system having a furnace which burns fuel to produce heat, a fuel oil line which feeds the furnace, a domestic hot water line at least part of which passes through the furnace to be heated therein, and a household baseboard heater line at least part of which passes through the furnace to be heated therein, the improvement comprising a fuel preheater positioned externally from said furnace, said preheater formed as a single unitary part and containing a narrow pipe and wide pipe, said narrow pipe being perpendicular to and extending transversely through said wide pipe, a coil of tubing located within said narrow pipe, connection means at each end of said coil tubing for connection along said fuel oil line at a part thereof prior to its feeding into the furnace, connection means at each end of said narrow pipe for connection along said domestic hot water line at a part thereof located subsequent said furnace, and connection means at each end of said wide pipe for connection to said household baseboard heater line at a part thereof subsequent to said furnace.

2. The improvement as set forth in claim 1 wherein pads and lugs are formed on said single part, said pads and lugs resting against a side of a removable flat panel.

3. The improvement as set forth in claim 2 wherein said connection means of said pipes comprise threaded openings, selectively engagable by plugs.

4. The improvement as set forth in claim 3 wherein a longitudinal concavity is formed along an outer side of said wide pipe.

* * * * *